United States Patent [19]

Kinney

[11] Patent Number: 4,869,793

[45] Date of Patent: Sep. 26, 1989

[54] METHOD OF PREPARING AN ASBESTOS DIAPHRAGM

[75] Inventor: Jerry N. Kinney, Lake Township, Trubull County, Ohio

[73] Assignee: PPG Industries, Inc., Pittsburgh, Pa.

[21] Appl. No.: 36,932

[22] Filed: Apr. 6, 1987

Related U.S. Application Data

[63] Continuation-in-part of Ser. No. 813,192, Dec. 24, 1985, abandoned.

[51] Int. Cl.[4] ..... C25B 1/16; C25B 1/26

[52] U.S. Cl. ..... 204/98; 204/128; 204/252; 204/283; 204/295; 162/153; 162/157.2; 162/157.6; 162/158; 162/157.7

[58] Field of Search ..... 204/98, 252, 283, 295; 162/153, 157.2, 157.6, 157.7, 158

[56] References Cited

U.S. PATENT DOCUMENTS 3,991,251 11/1976 Foster et al. ..... 204/295

4,204,938 5/1980 Bachot et al. ..... 204/252

FOREIGN PATENT DOCUMENTS 0200531 5/1983 Netherlands ..... 204/295

*Primary Examiner*—John F. Niebling

*Assistant Examiner*—Kathryn Gorgos

*Attorney, Agent, or Firm*—Edward J. Whitfield

[57] ABSTRACT

An electrolyte permeable diaphragm consisting essentially of asbestos is prepared by depositing asbestos and a porosity control agent selected from the group of cellulosic-type materials, e.g., starch, cellulose or rayon, infusible thermoset polymer materials, e.g., phenol-formaldehyde resin, urea-formaldehyde resin or melamine-formaldehyde resin, and inorganic materials, e.g., fiberglass, graphite, titania, silica, talc, vermiculite or potassium-containing mica from an aqueous slurry including alkali metal hydroxide onto a porous substrate, the porosity control agent being substantially stable and insoluble in the aqueous alkali metal hydroxide-containing slurry, followed by heating the deposited asbestos, porosity control agent and alkali metal hydroxide at temperatures between about 110° C. and 280° C. for a period of time sufficient to react the asbestos and alkali metal hydroxide whereby the porosity control agent provides the permeability for the diaphragm.

13 Claims, No Drawings

METHOD OF PREPARING AN ASBESTOS DIAPHRAGM

CROSS REFERENCE TO RELATED APPLICATION

This is a continuation-in-part of application Ser. No. 813,192 filed Dec. 24, 1985 now abandoned Apr. 18, 1987.

BACKGROUND OF THE INVENTION

The present invention relates to methods of preparing diaphragms consisting essentially of asbestos that are useful in electrolytic cells utilized for the electrolysis of aqueous salt solutions, especially useful in electrolytic cells utilized for the electrolysis of aqueous alkali metal halide solutions, e.g., sodium chloride brine.

Diaphragms are used in electrochemical processes to separate an anolyte liquor from a catholyte liquor while permitting the flow of electrolyte therethrough. Diaphragms are used, for example, to separate an oxidizing electrolyte from a reducing electrolyte, a concentrated electrolyte from a dilute electrolyte, or a basic electrolyte from an acidic electrolyte.

In the electrolysis of an aqueous alkali metal halide solution, the diaphragm separates an acidic anolyte from an alkaline catholyte. Historically, commercial chlor-alkali diaphragms have been made of asbestos. Such diaphragms have been prepared by vacuum-drawing a liquid slurry containing asbestos fibers onto a porous cathode thereby depositing a mat of asbestos on the cathode. Asbestos diaphragms typically are characterized by a short lifetime of about 6 to 8 months.

Numerous efforts have been made to improve the lifetimes and performances of asbestos diaphragms. For example, asbestos diaphragms, vacuum-deposited from an aqueous slurry containing sodium hydroxide, have been strengthened by heating the diaphragms to a temperature between about 110° Centigrade (C) and 280° C. for a sufficient period of time to react the sodium hydroxide and the asbestos, as taught by U.S. Pat. No. 3,991,251. However, these diaphragms can be too impermeable to the flow of electrolyte therethrough, thereby requiring a higher hydrostatic head of brine on the anolyte side of the diaphragm to maintain the desired electrolyte flow.

The following patents illustrate the use of materials, in particular fluorine-containing polymers, as binders with asbestos diaphragms. Generally, this technique includes mixing a slurry containing a particulate or fibrous binder material and asbestos fibers, depositing the solid materials as a mat on a porous cathode, and heating the diaphragm mat to sinter or melt the binder material, thereby effect bonding between the asbestos and binder. For example, U.S. Pat. No. 4,065,534 describes the codeposition of a thermoplastic resin with asbestos followed by melting the resin to bind the asbestos. U.S. Pat. No. 4,070,257 describes the preparation of a diaphragm mat containing asbestos and a fluorine-containing resin binder, followed by sintering the resin by heating the diaphragm for about 1 to 10 minutes at a temperature from the melting point of the resin to 100° C. above the melting point of the resin. U.S. Pat. No. 4,142,951 describes depositing a diaphragm of crocidolite asbestos, chrysotile asbestos and a polymeric fluorocarbon resin followed by heating to sinter the polymer resin and provide bonding between the asbestos and resin. Finally, U.S. Pat. No. 4,410,411 describes the codeposition of a fluorine-containing polymer and asbestos followed by heating at a temperature sufficient to fuse, soften, and flow the polymer and thereby bind the diaphragm.

SUMMARY OF THE INVENTION

In accordance with the present invention, diaphragms consisting essentially of asbestos can be prepared by providing an aqueous slurry including alkali metal hydroxide, asbestos and a porosity control agent, passing the slurry through a foraminous structure whereby a mat of asbestos, porosity control agent and alkali metal hydroxide is deposited thereon, and heating the deposited mat at temperatures between about 110° C. and 280° C. for a period of time sufficient to react the alkali metal hydroxide and asbestos. The porosity control agent can be selected from the group consisting of cellulose-type materials or inorganic materials and the porosity control agent is substantially stable and insoluble in the aqueous alkali metal hydroxide-containing slurry during deposition.

As used herein, the term "asbestos diaphragm" means a liquid permeable diaphragm consisting essentially of asbestos and does not include so-called modified asbestos diaphragms, i.e., those prepared by codepositing from an aqueous slurry both asbestos and polymeric resin, e.g., fluorinated polymeric resin, onto a substrate as described, for example, in U.S. Pat. Nos. 3,980,613 and 4,204,938.

The presently described method of preparing diaphragms provides a strengthened and substantially stable electrolyte permeable asbestos diaphragm useful in a chlor-alkali cell. A diaphragm of this invention can be utilized to electrolyze an alkali metal chloride brine in an electrolytic cell having an anolyte compartment with an anode therein, a catholyte compartment with a foraminous cathode therein and the electrolyte permeable asbestos diaphragm therebetween. The method of electrolyzing the brine further includes feeding the brine to the anolyte compartment, percolating the brine through the asbestos diaphragm to the catholyte compartment, passing an electric current from the anode to the cathode, and recovering chlorine and alkali metal hydroxide as products.

DETAILED DESCRIPTION OF THE INVENTION

According to this invention, an asbestos diaphragm is prepared by providing an aqueous slurry containing alkali metal hydroxide, asbestos and a porosity control agent selected from the group consisting of cellulosic-type materials and inorganic materials, passing the slurry through a foraminous substrate, e.g., a cathode, to deposit a mat of asbestos, porosity control agent and alkali metal hydroxide thereon, and heating the deposited mat at temperatures between about 110° C. and about 280° C. for a period of sufficient to react the alkali metal hydroxide and asbestos. While the mechanism is not precisely known, it is postulated that the heating step facilitates a reaction between asbestos and the alkali metal hydroxide whereby magnesium ions on the asbestos surface are displaced and alkali metal silicates are formed. While not wishino be bound by any theory, it is believed some alkali metal silicate precipitates as silica gel upon initial contact with an acidic anolyte, providing a tough adherent silica layer which is substantially inert to the anolyte. That is, the silica layer is more inert to the anolyte than is a conventional diaphragm. Further, alkali metal silicate crystals are believed to bind together and strengthen the diaphragm.

The asbestos used in the diaphragms of this invention is most commonly chrysotile asbestos, although crocidolite, anthophylite, cristobalite, amphibole, and serpentine forms of asbestos may be used. Typically, the asbestos can be selected from the various available grades, such as, Quebec Producers Association Quebec screen test grades 3T, 4T, 4D, and 4K or mixtures thereof and Vermong Asbestos Group grades $D_1$ and $D_2$ or mixtures thereof. The asbestos fibers are preferably of more than a single relatively uniform length. For best diaphragm performance, it is preferred that asbestos fibers of at least two substantially different lengths be utilized in preparing the diaphragm. For example, the asbestos fibers can be selected from among the various asbestos grades to provide mixtures of long fibers with an average length of about ½ inch and short fibers with an average length of about ¼ inch.

Typically, the slurry contains from about 0.5 to about 3.0 weight percent solids, i.e., asbestos and porosity control agent, basis total weight of the liquid and solids and from about 1 to about 30 weight percent porosity control agent, basis total weight of asbestos and porosity control agent, more preferably from about 2 to about 15 weight percent porosity control agent and most preferably from about 5 to about 10 weight percent porosity control agent. Concentrations of asbestos and porosity control agent lower than about 0.5 weight percent, while satisfactory in preparing a diaphragm according to this invention, require large amounts of slurry in order to build up a satisfactory thickness of the diaphragm mat. A slurry having total asbestos and porosity control agent concentrations greater than about 3 weight percent generally does not process properly due to thickening of the slurry.

The asbestos slurry has a pH greater than 7 and preferably greater than about 10. An alkaline pH is provided by an aqueous solution containing hydroxide ions. The slurry medium may be provided by an aqueous solution of an alkali metal hydroxide, e.g., sodium hydroxide or potassium hydroxide, or may be provided by cell liquor, i.e., sodium hydroxide and sodium chloride, or potassium hydroxide and potassium chloride. Alternatively, the slurry medium may be an aqueous solution of sodium carbonate or potassium carbonate. Generally, the aqueous solution of the slurry contains from about 100 to about 200 grams per liter alkali metal hydroxide and, when cell liquor is utilized as the slurry medium, from about 100 to about 300 grams per liter alkali metal chloride. When the slurry medium is cell liquor, i.e., a sodium chloride and sodium hydroxide mixture, the slurry generally contains from about 110 to about 150 grams per liter of sodium hydroxide and from about 120 to about 200 grams per liter of sodium chloride.

According to the method of this invention, the asbestos fibers and the porosity control agent are codeposited on a liquid permeable substrate. The codeposition may be accomplished by inserting the liquid permeable substrate into a slurry containing the asbestos and porosity control agent and drawing a vacuum within the substrate. The vacuum draws the slurry through the substrate, depositing a mat of asbestos and porosity control agent on the external surface of the substrate. The mat retains some residual slurry medium including some alkali metal hydroxide. By vacuum is meant producing a pressure differential between the outside of the liquid permeable substrate and the inside of the liquid permeable substrate. Typically, a vacuum of from about 15 to about 25 inches of mercury is built up and maintained within the liquid permeable substrate for a period of from about 10 to about 90 minutes. In this way, a diaphragm can be deposited having a weight of solids of from about 0.2 to about 0.4 pounds per square foot. According to one desirable practice, a vacuum of about 1.5 inches of mercury is maintained for several minutes and thereafter the vacuum is increased to about 2.5 inches and maintained thereat for several minutes. Gradually the vacuum is increased further to about 15 inches of mercury and maintained thereat for about 1 minute. Thereafter, the vacuum is increased still further to about 27 to 29 inches of mercury and maintained thereat until approximately 0.2 to 0.4 pounds of asbestos and porosity control agent per square foot of substrate area are deposited.

Other methods of depositing the diaphragm onto the substrate, e.g., a foraminous cathode, include the use of gravity flow or positive pressure to force the slurry against the porous surface, thereby depositing the solids in the form of a mat or web while the liquid slurry medium flows through the porous surface. Alternatively, the diaphragm mat or web may be prepared on a surface other than the cathode surface (such as by using a Fourdrinier process) and then transferred to the cathode surface.

The diaphragm of this invention is deposited upon a porous substrate, usually a porous metallic cathode. The porous or foraminous cathode is electroconductive and may be a perforated sheet, a perforated plate, metal mesh, expanded metal mesh, metal rods or the like. For example, the openings in the foraminous cathodes commercially used today in chlor-alkali cells are usually about 0.05 to 0.125 inches in size. Most commonly, the cathode will be of iron or an iron alloy. By iron alloy is meant a carbon steel or other alloy of iron. Alternatively, the cathode can be nickel or other cell environment resistant electroconductive material. Cathodes suitably used in this invention can include those having an activated surface coating, for example, those cathodes with a porous Raney nickel surface coating. Raney nickel coatings can provide a reduction of hydrogen over-voltage at the cathode and allow a significant savings in energy consumption and cost in the electrolysis of brine. Raney nickel coatings can be provided by various expedients well known to those skilled in the art.

The porosity control agent is a particulate material suitable to provide porosity and permeability to the diaphragm following the heat treatment in which the asbestos and alkali metal hydroxide are reacted. The porosity control agent should generally be substantially insoluble, stable and non-degradable by the slurry medium, i.e., the aqueous alkali metal hydroxide-containing slurry medium, during deposition with the asbestos. The porosity control agent may be selected from cellulosic-type materials, e.g., polysaccharides, such as starch and cellulose, or materials such as rayon, methylcellulose, cellulose acetate and starch acetate, from infusible thermoset polymer materials, e.g., phenol-formaldehyde resin, urea-formaldehyde resin and melamine-formaldehyde resin, and from inorganic materials, e.g., fiberglass, potassium-containing micas such as muscovite, phlogopite, biotite, or fluorophlogopite, zirconia, graphite, alumina, silica, talc, i.e., hydrous magnesium silicate, titania, vermiculite, and alkaline earth metal titanates, carbonates, zirconates, silicates, aluminates or mixtures thereof, e.g., barium carbonate, barium silicate, barium titanate, barium zirconate, calcium carbonate, calcium silicate, calcium aluminate, calcium titanate, calcium zirconate, calcium zirconium silicate, magnesium carbonate, magnesium titanate, magnesium zirconium silicate or magnesium zirconate. Preferably, the inorganic material is selected from among the materials such as fiberglass, potassium-containing micas, vermiculate, graphite, titania, silica, alumina, talc, calcium carbonate or magnesium carbonate. By particulate is meant as granules or particles with a size range of 0.01 to 250 microns in diameter or as fibers with a fiber length of up to about ¾ inch and diameters of about 0.01 to 250 microns.

While not wishing to be bound by any theory, it is believed that the porosity control agent may function as a propping agent during the heat treatment thereby providing fractures or passageways. By subsequent chemical action upon the porosity control agent, e.g., by chemical treatment, the porosity control agent may be partially or totally removed, e.g., by leaching, thereby providing further diaphragm permeability. Alternatively, in another mode of operation, some of the porosity control agent may be degraded by the heat treatment, i.e., the heat treatment can result in burning, vaporizing, oxidizing or decomposing of the porosity control agent at the temperatures whereat the alkali metal hydroxide and asbestos are reacted.

Following deposition of the mat of asbestos and porosity control agent upon the foraminous structure, the deposited mat generally retains some residual liquid slurry medium. The residual liquid slurry medium retained by the diaphragm provides the alkali metal ions necessary to react with the asbestos. Alkali metal ions are most conveniently provided by the alkali metal hydroxide in the aqueous slurry. The deposited mat will generally retain from about 30 percent to about 60 percent by weight liquid slurry medium based on the total weight of the deposited mat. Sufficient alkali metal hydroxide for the reaction is generally present when the mat is slightly damp to the touch.

In one embodiment of the invention, the method of preparing the electrolyte permeable asbestos diaphragm can also include maintaining a flow of inert gas through the deposited mat while the mat is heated at temperatures between about 110° C. and 280° C. for a period of time sufficient to react the alkali metal hydroxide and asbestos. By inert is meant the gas does not undergo any chemical reaction. The gas can be most conveniently air, or can be an gas such as, e.g., nitrogen. The flow rate of gas through the diaphragm is a function of the pressure differential across the diaphragm, the porosity of the diaphragm, and the thickness of the diaphragm. For example, air may be drawn through the mat by applying a low vacuum, e.g., a vacuum of from about 2 inches of mercury to about 15 inches of mercury inside of the foraminous structure during heating of the mat. Maintaining an air flow through the diaphragm during heating assists in controlling the porosity and permeability of the diaphragm to desired levels.

In a preferred preparation of a diaphragm according to the herein described invention, an aqueous slurry containing from about 110 to 150 grams per liter of sodium hydroxide, from about 120 to 200 grams per liter of sodium chloride, from about 0.5 to 3.0 weight percent total solids, i.e., asbestos and porosity control agent, basis total weight of the liquid and the solids, and from about 2 to 15 weight percent of the porosity control agent, basis total weight of asbestos and porosity control agent, is vacuum-drawn through a foraminous metallic cathode to deposit a mat of the solids thereon. The deposited mat, including asbestos, the porosity control agent and sodium hydroxide, is then heated at temperatures and for a period of time sufficient to react the sodium hydroxide and asbestos.

This reaction may be accomplished by heating the asbestos mat at temperatures above about 110° C., more preferably between about 110° C. and about 280° C., most preferably between about 140° C. and about 220° C., and maintaining the mat at the reaction temperature for a period of time sufficient to achieve complete reaction. For example, the mat may be maintained at a single temperature between about 140° C. and about 220° C., or the mat may be maintained at a sequence of temperatures from about 140° C. to 220° C. Preferably, the mat is gradually heated from ambient temperature to a finally selected temperature within the desired temperature range. A gradual rise in temperature can help avoid any boiling of residual liquid within the diaphragm mat and avoid blistering of the diaphragm.

The asbestos mat is maintained at the desired temperature or in the desired temperature range for the period of time sufficient to react the asbestos and sodium hydroxide and provide a tough stable diaphragm. The period of time sufficient for this reaction to occur may vary depending upon the heating temperature and will generally be, for example, at least about 2 hours, usually at least about 4 hours and most often from at least about 6 hours to about 16 hours or longer. The porosity control agent improves permeability and porosity in the asbestos diaphragm following the heating stage and the resultant diaphragm can be readily utilized in place of conventional asbestos diaphragms.

The diaphragm prepared by the method of this invention has a porosity and permeability that allows brine subjected to a pressure gradient to flow through the diaphragm at a rate from about 0.01 to about 0.15 cubic centimeters per square centimeter of diaphragm surface area per minute. The pressure gradient is typically the result of a hydrostatic head on the anolyte side of an electrolytic cell, e.g., a differential level in the anolyte compartment on the order of about 3 to about 80 inches, whereby to provide a cell liquor containing from about 10 to 12 weight percent alkali metal hydroxide and about 10 to 15 weight percent alkali metal chloride at a current efficiency of about 90 percent or above. Differential level is the difference between the brine feed level in the anolyte compartment and the cell liquor level in the catholyte compartment. The diaphragm preferably operates with a differential level of about 3 to about 80 inches, more preferably from about 12 to about 45 inches. Sometimes it may be advantageous to have the chlorine gas above atmospheric pressure in the anolyte compartment thereby to increase the pressure gradient.

After a diaphragm of this invention is prepared, it can be assembled into an electrolytic cell. The cell can include an anode in an anolyte compartment, a foraminous cathode in a catholyte compartment, and the electrolyte permeable asbestos diaphragm therebetween upon the foraminous cathode. The electrolytic cell can then be utilized to electrolyze alkali metal chloride brine to produce alkali metal hydroxide and chlorine. The electrolysis of the alkali metal chloride brine includes feeding brine as an electrolyte to the anolyte compartment of the electrolytic cell, applying a hydrostatic head or pressure to the brine in the anolyte compartment, whereby the brine electrolyte is percolated through the diaphragm, passing electric current from the anode to the cathode, and recovering alkali metal hydroxide and chlorine as products from the cell.

In one embodiment of the present invention, an aqueous slurry containing alkali metal hydroxide, asbestos and rayon fibers as the porosity control agent is prepared. The slurry is passed through a foraminous cathode by drawing a vacuum from within the cathode substrate whereby a mat of asbestos, rayon fibers and alkali metal hydroxide is deposited thereon. The deposited mat is dried at about 100° C. for a period of about 1 to 3 hours, and then heated at temperatures of from about 215° C. to 220° C. over a period of about 8 hours to react the alkali metal hydroxide and asbestos. The diaphragm is allowed to cool and placed into a electrolytic cell and operated to produce sodium hydroxide and chlorine by the electrolysis of sodium chloride brine.

The following examples are illustrative of the present invention. Many modifications and variations of the present invention are possible in light of the present disclosure. It is therefore to be understood that the invention may be practiced otherwise than as specifically described and is limited only by the claims attached hereto.

EXAMPLE 1

An asbestos diaphragm was prepared with rayon fibers as a porosity control agent or propping agent and tested in a laboratory cell. An aqueous slurry was prepared containing 1.0 gram (g) of rayon fibers of about ¼ inch length and less than 18 micron diameter, 1.4 g of long asbestos fibers (grade 3T), 7.6 g of short asbestos fibers (grade 4K) and 500 millileters (ml) of aqueous cell liquor (15 percent by weight sodium chloride and 10 percent by weight sodium hydroxide). A small portion of a surfactant (Merpol® SE available from E. I. DuPont de Nemours & Co.), i.e., less than 0.01 weight percent on the basis of total slurry weight, was added to the slurry with the rayon fibers.

The slurry was aged for two days. Immediately prior to deposition, the slurry was agitated for one hour. Following the agitation, the slurry was vacuum deposited on a 3 inch by 3 inch mold steel wire mesh cathode having 6 mesh per inch mild steel wire and approximately 60 percent open area. The deposited diaphragm remained slightly damp indicating the retention of a small amount of cell liquor. The diaphragm and cathode assembly were placed into an oven at room temperature. The oven temperature was raised to about 104° C. and maintained at 104° C. for 3 hours, raised to about 182° C. over a 7 hour period at about 11° C. per hour, raised to 218° C. over a one hour period and finally maintained at 218° C. for 2 hours. The diaphragm-cathode assembly was removed from the oven and allowed to cool. The resultant diaphragm had a weight of about 0.32 pounds per square foot.

The cathode and diaphragm were installed in a laboratory test cell with a ruthenium dioxide-titanium dioxide coated titanium mesh anode spaced about 0.25 inch from the cathode. Electrolysis of a saturated sodium chloride brine heated at about 90° C. was commenced at a current density of 190 amperes per square foot (ASF). Through 144 days of electrolysis, the following average results were obtained: cathode cell efficiency 94.3 percent; cell voltage 3.23 volts; brine head differential level 14.9 inches; and catholyte liquor product 10.8 weight percent sodium hydroxide.

EXAMPLE 2

An asbestos diaphragm was prepared and operated substantially as in Example 1 except that only 0.5 g rayon fibers were added with 9.5 g of asbestos to the slurry. Through 82 days of electrolysis, the following average results were obtained: cathode cell efficiency 94.5 percent; cell voltage 3.24 volts; brine head differential level 17.7 inches; catholyte liquor product 10.6 weight percent sodium hydroxide.

EXAMPLE 3

An asbestos diaphragm was prepared and tested in a laboratory cell substantially as in Example 1 with fiberglass as a porosity control agent or propping agent. The fiberglass had about 1/4 inch length and was added with asbestos to the cell liquor slurry in an amount of 10 weight percent on the basis of total solids asbestos and fiberglass. The results diaphragm had a total diaphragm weight (asbestos plus fiberglass) of about 0.35 pounds per square foot. Through 20 days of electrolysis, the following average results were obtained: cathode cell efficiency 93.2 percent, cell voltage 3.57; brine head differential level 10.6 inches; catholyte liquor product 10.4 weight percent sodium hydroxide.

EXAMPLE 4

An asbestos diaphragm was prepared and operated substantially as in Example 3 with 5 weight percent fiberglass on the basis of total weight asbestos and fiberglass in the slurry. Through 29 days of electrolysis, the following average results were obtained: cathode cell efficiency 92.8 percent; cell voltage 3.26 volts; brine head differential level 9.6 inches; and catholyte liquor product 10.9 weight percent sodium hydroxide.

I claim:

1. A method of depositing a liquid permeable diaphragm consisting essentially of asbestos on a foraminous cathode structure by:

(a) providing an aqueous slurry of alkali metal hydroxide, asbestos and from about 1 to 15 weight percent of particulate porosity control agent, basis total weight of asbestos and porosity control agent, said porosity control agent being substantially stable and insoluble in the slurry but removable from the diaphragm, said porosity control agent selected from the group consisting of celluosic-type material, inorganic material and thermoset polymer material;

(b) contacting a formainous cathode structure with the slurry so as to deposit on the foraminous cathode structure a mat of alkali metal hydroxide, asbestos and particulate porosity control agent; and (c) heating the formainous cathode structure having the mat deposited thereon at a temperature in the range of from about 110° C. to about 280° C. for at least two hours.

2. The method of claim 1 wherein the heating temperature is in the range of from about 140° C. to about 220° C.

3. The method of claim 1 wherein the porosity control agent is a celluosic-type material selected from the group consisting of starch, celluose, rayon, celluose acetate, starch acetate and methyl celluose.

4. The method of claim 3 wherein the porosity control agent is rayon.

5. The method of claim 1 wherein the porosity control agent is an inorganic material selected from the group consisting of fiberglass, graphite, potassium-containing mica, titania, zirconia, alumina, silica, talc, vermiculite, and alkaline earth metal carbonates, silicates, aluminates, titanates, zirconates or mixtures thereof.

6. The method of claim 5 wherein the porosity control agent is fiberglass.

7. The method of claim 1 wherein the porosity control agent is an infusible thermoset polymer material selected from the group consisting of phenol-formaldehyde resin, urea-formaldehyde resin and melamine-formaldehyde resin.

8. The method of claim 1 wherein the alkali metal hydroxide is sodium hydroxide.

9. The method of claim 1 wherein the slurry contains alkali metal chloride.

10. The method of claim 9 wherein the alkali metal chloride is sodium chloride.

11. The method of claim 1 wherein a flow of inert gas is maintained through the deposited mat during heating.

12. In an electrolytic cell having an anode disposed in an anolyte compartment, a cathode disposed in a catholyte compartment and a liquid permeable asbestos diaphragm disposed therebetween and deposited on the foraminous cathode wherein the diaphragm-cathode structure is one prepared by the method defined in claim 1.

13. In a method of producing chlorine and alkali metal hydroxide in an electrolytic cell by feeding aqueous alkali metal chloride solution into the anolyte compartment of the cell having an anode disposed therein, percolating the brine through a liquid permeable asbestos diaphragm into a catholyte compartment having a foraminous cathode disposed therein and recovering chlorine and alkali metal hydroxide products from the cell, the asbestos diaphragm having been deposited on the foraminous cathode according to the method defined in claim 1.

* * * * *